United States Patent [19]

Green et al.

[11] Patent Number: 4,493,464

[45] Date of Patent: Jan. 15, 1985

[54] PACKAGED STRAND

[75] Inventors: William A. Green, Swanton, Ohio; Joe E. Godfrey; David S. Pietsch, both of Amarillo, Tex.

[73] Assignee: Owens-Corning Fiberglas Corporation, Toledo, Ohio

[21] Appl. No.: 533,698

[22] Filed: Sep. 19, 1983

[51] Int. Cl.[3] ..... B65H 55/02; B65H 49/00; B65D 85/671

[52] U.S. Cl. ..... 242/170; 206/410; 206/497; 242/172

[58] Field of Search ..... 206/410, 497, 45.33; 242/159, 170; 229/DIG. 12

[56] References Cited

U.S. PATENT DOCUMENTS

| | | | |
|---|---|---|---|
| 3,915,301 | 10/1975 | Gray et al. | 206/410 |
| 4,220,295 | 9/1980 | Green et al. | 206/410 |
| 4,300,734 | 11/1981 | Green et al. | 206/410 |

*Primary Examiner*—William T. Dixson, Jr.

*Attorney, Agent, or Firm*—Ronald C. Hudgens; Philip R. Cloutier

[57] ABSTRACT

A method of facilitating the unwinding of a wound body of strand includes encompassing the body in a heat-shrinkable stretch membrane and heating the resulting composite to a temperature greater than the temperature at which the strand is to be wound.

5 Claims, No Drawings

PACKAGED STRAND

BACKGROUND OF THE INVENTION

This invention relates to packaged strands. In one of its more specific aspects, this invention relates to packaged strand which is maintained in packaged form as the strand is drawn therefrom.

Various systems for packaging strand have been disclosed in the prior art.

U.S. Pat. No. 4,220,295, the disclosure of which is incorporated herein by reference, discloses a package of strand around which an elastic membrane is wound, the membrane being of sufficient thickness and sufficiently stretched to partially collapse as the strand is withdrawn from the interior of the body. During the withdrawal, the membrane frictionally captures the strand of the outer cylindrical portion of the package to retain the strand in contact with the membrane until the strand is withdrawn to substantial elimination of the package.

U.S. Pat. No. 4,300,734, the disclosure of which is also incorporated herein by reference, is similarly directed. In that package, the membrane is convolutely wound about the cylindrical portion of the package in one or in a plurality of plies, and a control layer of material having different physical characteristics, for example, paper, polymer or fibrous glass, is positioned between the plies of the membrane, to limit the collapse of the membrane to a predetermined amount.

Both of these packages and packaging methods have found wide acceptance in industry. However, at temperatures above 90° F. the exterior membrane in which the package is wrapped tends to relax with the result that the strand being withdrawn tends to birdnest and become entangled in the guide eye.

This invention is directed to the solution of that problem.

STATEMENT OF THE INVENTION

According to this invention, there is provided a method of packaging a wound body of strand which comprises circumferentially winding around the body a heat shrinkable, elastic stretch membrane. The membrane is placed in tension and the wrapped body is heated to a temperature at least equal to the temperature at which the strand is to be withdrawn from the package.

Also, according to this invention, there is provided a package comprising a wound body of strand, the package having wound about its outer periphery a shrinkable, elastic stretch film, or membrane, the body and the membrane having been heated to a temperature at least equal to the temperature at which the strand is to be withdrawn from the package.

DETAILED DESCRIPTION OF THE INVENTION

This invention pertains to any wound body of strand from which the strand is withdrawn from the interior of the body. Such bodies can comprise natural or synthetic fibers, organic fibers or mineral fibers of any length, diameter or quality. Such packages are generally formed by winding a continuous strand on a rotatable collet to form a hollow core package from which the strand is pulled out through the opening formed by the position occupied by the rotating collet.

The package can be of any size and shape. Because such packages are wound on a collet, they will generally be cylindrical in shape. The outer periphery of the wound body usually develops a plurality of undulations, or ridges, of irregular height which act to adhere to the outer wrap and, hence, to preserve the cylindrical shape of the package as it is being unwound.

The shrinkable membrane will be a stretch film, in contrast to a shrink film, and will be wrapped around the wound package to produce about 5 percent stretch in the film, that is, the film is wrapped under tension. Preferably, it will be of low density polyethylene or lineal low density polyethylene which, when heated to a temperature greater than the temperature at which the strand is to be withdrawn from the package, that is, for example, a temperature within the range of from about 110° F. to about 350° F., preferably, from about 200° F . to about 300° F., results in a unified membrane which conforms to the plurality of undulations on the circumference of the package. This allows the membrane to adhere to the outer periphery of the package to an extent sufficient to retain the strand in contact with the membrane until the strand is substantially completely withdrawn from the package at a predetermined time. The membrane remains dimensionally stable as the wound body of strand is withdrawn. There is an absence of a compressive force such as that which exists in the prior art.

The use of a stretch film herein is in contrast to the frequent use of shrink films to wrap food-stuffs. Shrink film packaging involves the use of thermoplastic films that have been stretched or oriented during manufacturing and have the property of shrinking during the application of heat. Shrink film is normally applied loosely because it does not stretch well at room temperatures. Shrink film is normally produced in thicknesses ranging from 1 mil to 6 mils.

Stretch film involves the use of thermoplastic film that has been specially formulated to easily stretch at room temperatures. Stretch film is normally produced in thicknesses ranging from 0.7 mils to 1.5 mils.

The shrinkable membrane can be wrapped around the package in any number of convolutions, or portion thereof, and can be of any suitable thickness, for example, within from about 0.7 mil to about 1.35 mil, preferably from about 0.8 to about 1 mil. Applying the film under tension holds the film in position during the shrinking process. The shrinking process softens the film so that the tension which was applied by the stretch process forces the film to conform to the plurality of undulations of the package. When the film cools it continues to conform to the plurality of undulations of the package. The film will then support the package strands during run out.

The wound body of strand can be encased fully or partially within the membrane. Preferably, the membrane will be positioned in contact with the entire longitudinal surface of the package although the membrane can extend over any portions of the ends of the package.

The membrane can be wound on the package of strand by any suitable means and at any time after the formation of the package.

The wrapped body of strand can be heated in any suitable manner. For example, it can be heated by contact with hot gases, indirectly by radiation, electric means, and the like. The wrapped strand can be heated in one or more steps at the same, or different, temperatures. The impartation to the membrane of a static charge facilitates adherence between the strand and the membrane.

It is evident from the foregoing that various modifications can be made to this invention. Such, however, are within the scope of the invention.

What is claimed is:

1. A package comprising:

(a) an unwindable wound body of strand;

(b) a heat shrinkable, stretch membrane convolutely positioned about the wound body, said body and said membrane having been heated to place said membrane in conformance to the pluralities of undulations on said wound body, said body and said membrane having been heated to a temperature greater than the temperature at which said strand is thereafter unwound said temperature being in the range from about 110° F. to about 350° F.

2. The package of claim 1 in which said control layer is positioned immediately adjacent the outermost layer of the wound strand.

3. The package of claim 1 in which said body and said membrane have been heated to a temperature of about 110° F.

4. A method comprising:

(a) forming an unwindable wound body of strand;

(b) at least partially encasing a portion of said body in a heat-shrinkable stretch membrane;

(c) heating the encased body of strand to a temperature greater than the temperature at which said body of strand is to be unwound said temperature being within the range of from about 110° F. to about 350° F.; and, (d) unwinding said strand.

5. The method of claim 4 in which said control layer is positioned immediately adjacent the outermost layer of the wound strand.

* * * * *